US012680418B1

(12) United States Patent
Morrison et al.

(10) Patent No.: US 12,680,418 B1
(45) Date of Patent: Jul. 14, 2026

(54) STAGE COLLAR AND RELATED METHODS FOR OPERATION

(71) Applicant: FORUM US, INC., Houston, TX (US)

(72) Inventors: Jeffery Morrison, Missouri City, TX (US); Tabitha Katelyn Fox, Houston, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 19/243,394

(22) Filed: Jun. 19, 2025

(51) Int. Cl.
*E21B 33/14* (2006.01)
*E21B 34/10* (2006.01)
*E21B 34/14* (2006.01)

(52) U.S. Cl.
CPC ..... *E21B 33/146* (2013.01); *E21B 34/103* (2013.01); *E21B 34/142* (2020.05); *E21B 2200/06* (2020.05)

(58) Field of Classification Search
CPC ..... E21B 33/127; E21B 33/146; E21B 33/14; E21B 34/103; E21B 34/142; E21B 2200/06
See application file for complete search history.

(56) References Cited

U.S. PATENT DOCUMENTS 2,998,075 A * 8/1961 Clark, Jr. ..... E21B 33/14 166/194
3,131,767 A 5/1964 Chancellor et al.
3,183,974 A * 5/1965 Baker ..... E21B 33/14 166/194
3,223,160 A * 12/1965 Baker ..... E21B 33/146 166/194
3,228,473 A * 1/1966 Baker ..... E21B 33/146 166/318
3,331,378 A * 7/1967 Gibbs ..... E21B 34/103 137/515
3,338,311 A 8/1967 Conrad
3,633,671 A * 1/1972 Nelson ..... E21B 34/142 166/318
3,789,926 A 2/1974 Henley et al.
3,948,322 A * 4/1976 Baker ..... E21B 33/127 166/187
4,260,017 A * 4/1981 Nelson ..... E21B 34/14 166/318
4,421,165 A * 12/1983 Szarka ..... E21B 34/14 166/151
4,479,545 A * 10/1984 Eley ..... E21B 33/146 166/318
4,850,432 A * 7/1989 Porter ..... E21B 33/16 166/166
5,024,273 A * 6/1991 Coone ..... E21B 34/142 166/383
5,109,925 A * 5/1992 Stepp ..... E21B 33/146 166/324

(Continued)

*Primary Examiner* — Jennifer H Gay
(74) *Attorney, Agent, or Firm* — Patterson + Sheridan, LLP

(57) ABSTRACT

A stage collar having a mandrel and a closing sleeve disposed in and releasably coupled to the mandrel. One or more ports of the closing sleeve align with one or more ports of the mandrel when the stage collar is in a run in position. An opening sleeve is disposed in and releasably coupled to the mandrel. A protection sleeve is disposed in and releasably coupled to the opening sleeve. The protection sleeve comprises one or more seals configured to seal one or more bores formed through a sidewall of the opening sleeve when the stage collar is in the run in position.

18 Claims, 4 Drawing Sheets

(56) References Cited

U.S. PATENT DOCUMENTS 5,368,098 A * 11/1994 Blizzard, Jr. ..... E21B 33/146 166/387
6,253,861 B1 * 7/2001 Carmichael ..... E21B 21/019 175/317
7,500,526 B2 * 3/2009 Telfer ..... E21B 34/142 166/387
7,878,257 B2 * 2/2011 Chen ..... E21B 33/126 166/318
8,230,926 B2 * 7/2012 Rogers ..... E21B 43/103 166/212
8,251,154 B2 * 8/2012 Duphorne ..... E21B 34/103 166/194
8,496,051 B2 * 7/2013 Cejero ..... E21B 33/16 29/897.3
8,708,056 B2 * 4/2014 Helms ..... E21B 33/128 166/387
9,567,832 B2 * 2/2017 Hofman ..... E21B 34/08
10,316,645 B2 * 6/2019 Ingraham ..... E21B 47/09
10,633,949 B2 * 4/2020 Tilley ..... E21B 34/14
11,118,423 B1 * 9/2021 Helms ..... E21B 33/1208
11,306,562 B1 * 4/2022 Giroux ..... E21B 34/142
11,391,117 B2 7/2022 Acosta et al.
11,578,548 B2 2/2023 Webber et al.
11,885,197 B2 * 1/2024 Patil ..... E21B 33/146
11,952,860 B2 * 4/2024 Qin ..... E21B 33/146
12,024,977 B2 7/2024 Webber et al.
12,055,012 B1 8/2024 Elkhalil et al.
12,078,026 B2 9/2024 Morrison et al.
12,123,280 B2 10/2024 Webber et al.
12,221,851 B1 2/2025 Morrison
12,305,453 B2 5/2025 Morrison
12,486,753 B2 * 12/2025 Lei ..... E21B 33/16
2007/0240883 A1 * 10/2007 Telfer ..... E21B 34/142 166/381
2010/0212911 A1 * 8/2010 Chen ..... E21B 23/08 166/373
2011/0030975 A1 * 2/2011 Duphorne ..... E21B 23/006 166/194
2011/0079381 A1 * 4/2011 Cejero ..... E21B 33/16 29/897.3
2014/0251636 A1 * 9/2014 Hofman ..... E21B 34/103 166/373
2016/0084075 A1 * 3/2016 Ingraham ..... E21B 23/01 166/53
2019/0284899 A1 * 9/2019 Tilley ..... E21B 33/143
2023/0139858 A1 * 5/2023 Patil ..... E21B 33/146 166/289
2023/0142393 A1 * 5/2023 Qin ..... E21B 33/126 166/289

* cited by examiner

STAGE COLLAR AND RELATED METHODS FOR OPERATION

BACKGROUND

Field

Aspects of the disclosure relate to stage collars and related methods for operation thereof.

Description of the Related Art

A stage collar is a tool is used to cement multiple sections of a wellbore in different stages. The stage collar includes multiple moving parts to open and close various cementing ports. Stage collars can be complex and can involve drilling out of numerous components. Therefore, there is a continuous need for new and improved stage collars that facilitate reliable operation, reduced operational delays, and reduced costs.

SUMMARY

In one or more embodiments, a stage collar for stage cementing operations has an upper mandrel, a lower mandrel, a closing sleeve, a lock ring, and one or more closing pins. The closing sleeve is disposed in the upper mandrel and has one or more ports in alignment with one or more ports of the upper mandrel when the stage collar is in a run in configuration. The lock ring is disposed between the closing sleeve and a first recess formed in an inner surface of the upper mandrel. The closing pins are disposed through the closing sleeve and configured to move the lock ring into a second recess formed in the inner surface of the upper mandrel when the stage collar is moved to a closed configuration.

In one embodiment, a stage collar comprises a mandrel; an inflatable packer coupled to the mandrel; a closing sleeve disposed in and releasably coupled to the upper mandrel, wherein the closing sleeve has one or more ports in alignment with one or more ports of the mandrel when the stage collar is in a run in position; an opening sleeve disposed in and releasably coupled to the mandrel; and a protection sleeve disposed in and releasably coupled to the opening sleeve, wherein the protection sleeve comprises one or more seals configured to seal one or more bores formed through a sidewall of the opening sleeve when the stage collar is in the run in position.

In one embodiment, a method of operating a stage collar comprises lowering the stage collar in a wellbore in a run in position; pumping a closing device into the stage collar such that a first outer seating surface of the closing device engages an inner seating surface of a protection sleeve disposed within an opening sleeve of the stage collar; pressurizing the stage collar to shear one or more shearable members disposed between the protection sleeve and the opening sleeve; and moving the protection sleeve relative to the opening sleeve to open fluid communication through one or more bores formed in a sidewall of the opening sleeve.

In one embodiment, a method of operating a stage collar comprises lowering the stage collar in a wellbore in a run in position; pumping a closing device into the stage collar such that a first outer seating surface of the closing device engages an inner seating surface of a protection sleeve disposed within an opening sleeve of the stage collar; moving the protection sleeve relative to the opening sleeve to open fluid communication through one or more bores formed in a sidewall of the opening sleeve; pumping fluid through the bores to inflate an inflatable packer; moving the closing device such that a second outer seating surface of the closing device engages an inner seating surface of a closing seat coupled to a closing sleeve of the stage collar; and moving the closing sleeve to move a lock ring outward into a recess formed in a mandrel of the stage collar to place the stage collar into a closed and locked position.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
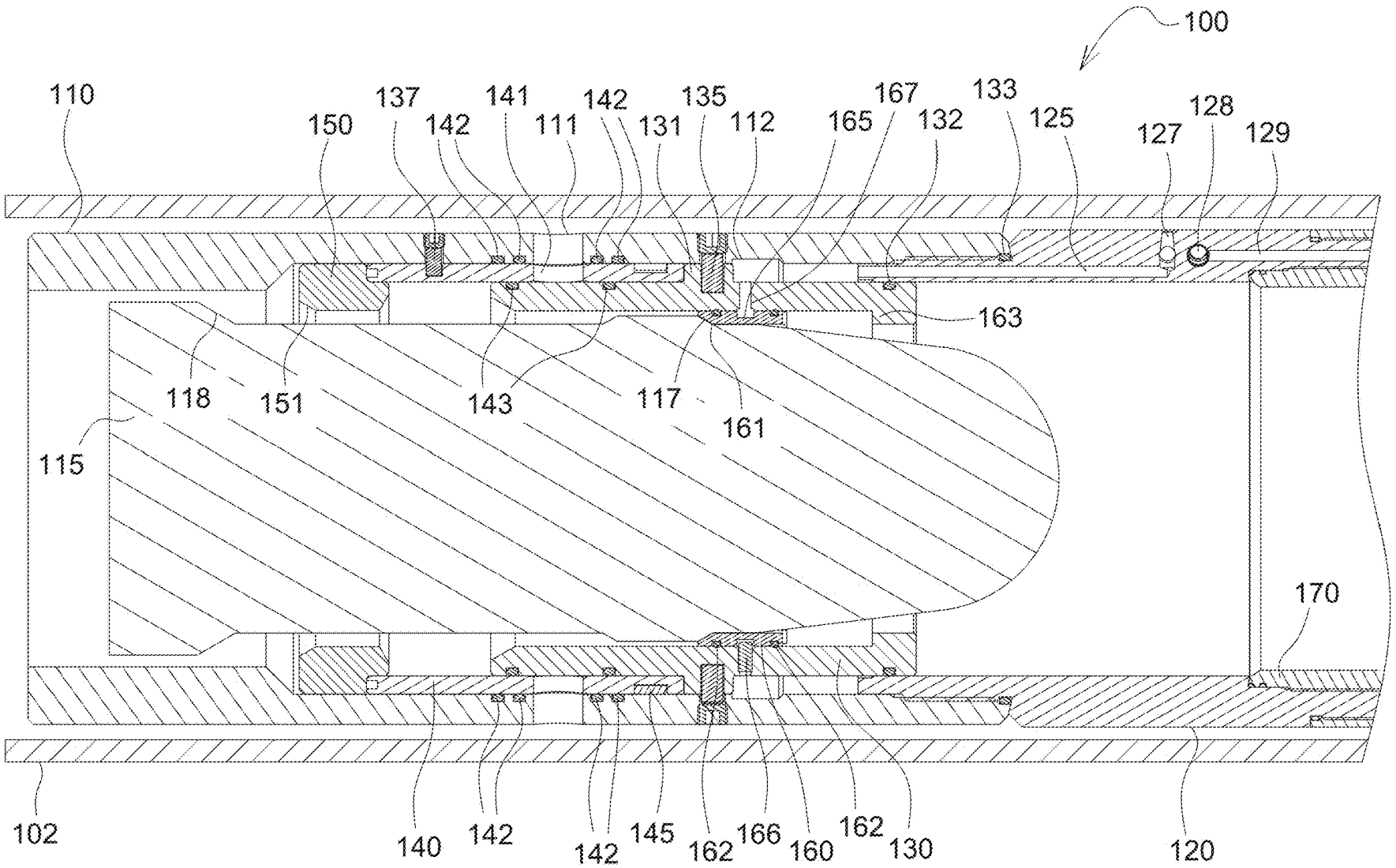
FIG. 1 is a cross-sectional view of a closing device in a stage collar in a first operational position, according to one or more embodiments.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Aspects of the disclosure relate to stage collars and related methods of operation. The stage collar is used to conduct one or more stage cementing operations. The stage collar includes at least one inflatable packer. The stage collar is configured to be actuated into a position that allows the packer to be inflated and then subsequently actuated into a closed position to cancel the further operation of the stage collar, all using a single closing device. The operation of enabling the packer to be inflated and then canceling of the stage collar is useful in instances where the inflated packer is needed but cementing through the cementing ports of the stage collar is no longer needed (for various reasons) subsequent to the stage collar already being positioned in a wellbore.

In one embodiment, a closing device is pumped onto a protection sleeve of a stage collar, shifts the protection sleeve into an open position, which allows a packer to be inflated. After the packer is inflated, the closing device can then shift an opening sleeve and then a closing sleeve (of the stage collar) into a closed and locked position, to thereby closing and preventing any fluid flow through cementing ports of the stage collar.

FIG. 1 is a cross-sectional view of a closing device 115 in a stage collar 100 in a first operational position, according to one or more embodiments. The stage collar 100 is lowered into a wellbore 102 to a desired location in the first operational position, which includes a run in position. Fluid can flow freely through the inner bore of the stage collar 100 when lowered into the wellbore 102 and before the closing device 115 is pumped into the stage collar 100.

The stage collar 100 includes an upper mandrel 110, also referred to as a barrel, coupled to a lower mandrel 120, such as by a threaded connection. The upper and lower mandrels 110, 120 are in the form of tubular members having bores that are formed through the tubular members and that are in fluid communication with each other. The stage collar 100 further includes an opening sleeve 130, a closing sleeve 140, a lock ring 145, a closing seat 150, and a protection sleeve 160 disposed in at least the upper mandrel 110. The stage collar 100 further includes an inflatable packer 170 coupled and in fluid communication with the lower mandrel 120. The opening sleeve 130, the closing sleeve 140, the lock ring 145, the closing seat 150, and the protection sleeve 160 are also in the form of tubular members having bores that are formed through the tubular members and that are in fluid communication with each other.

One or more cementing ports 111 are formed through the sidewall of the upper mandrel 110. One or more cementing ports 141 are formed through the sidewall of the closing sleeve 140. The cementing ports 111 of the upper mandrel 110 are aligned with the cementing ports 141 of the closing sleeve 140 when the stage collar 100 is in the run in position. A plurality of seals 142, such as O-rings, are positioned and form a seal between the closing sleeve 140 and the upper mandrel 110 above and below the cementing ports 111, 141. The closing seat 150 is coupled to an end of the closing sleeve 140 and has an inner seating surface 151 configured to receive a second outer seating surface 118 of the closing device 115. The closing sleeve 140 is releasably coupled to the upper mandrel 110 by one or more shearable members 137. The shearable members 137 are at least partially disposed through the sidewalls of the upper mandrel 110 and the closing sleeve 130. One or more seals, such as O-rings, can be positioned above and below the shearable members 137 between the closing sleeve 140 and the upper mandrel 110 (similar to the seals 142).

A plurality of seals 143, such as O-rings, are positioned and form a seal between the opening sleeve 130 and the closing sleeve 140 above and below the cementing ports 141 when the stage collar 100 is in the run in position. The lock ring 145 is disposed within a recess formed in the outer surface of the closing sleeve 140. The opening sleeve 130 has an outer shoulder 131 that abuts the lower end of the closing sleeve 140. The opening sleeve 130 is releasably coupled to the upper mandrel 110 by one or more shearable members 135. The shearable members 135 are at least partially disposed through the sidewalls of the upper mandrel 110 and the opening sleeve 130 (such as extending into the outer shoulder 131 of the opening sleeve 130). The opening sleeve 130 is at least partially disposed in the lower mandrel 120. One more seals 132, such as O-rings, are positioned and form a seal between the opening sleeve 130 and the lower mandrel 120. One more seals 133, such as O-rings, are positioned and form a seal between the upper mandrel 110 and the lower mandrel 120.

The protection sleeve 160 is disposed within the opening sleeve 130 and has an inner seating surface 161 configured to receive a first outer seating surface 117 of the closing device 115. The closing device 115 may be in the form of a plug member, such as a dart or cone, to close fluid flow through the opening sleeve 130, which thereby closes fluid flow through the upper mandrel 110 and the lower mandrel 120. The protection sleeve 160 is releasably coupled to the opening sleeve 130 by one or more shearable members 166. The shearable members 166 are disposed through one or more bores 167 formed though the sidewall of the opening sleeve 130 and extend into a groove 165 formed in the outer surface of the protection sleeve 160. Some of the bores 167 may not contain any shearable members 166. A plurality of seals 162, such as O-rings, are positioned and form a seal between the opening sleeve 130 and the protection sleeve 160 above and below the shearable members 166 and the bores 167 when the stage collar 100 is in the run in position. The seals 162 prevent fluid flow through the bores 167 of the opening sleeve 130 when in the run in position.

With reference to FIG. 1, when the stage collar 100 is in the wellbore 102 at the desired location in the run in position, the closing device 115 can be pumped down into the stage collar 100. The first outer seating surface 117 of the closing device 115 engages the inner seating surface 161 of the protection sleeve 160, which closes fluid flow through the opening sleeve 130 and thus the stage collar 100. Pressure from above can be increased to apply a force on the closing device 115, which applies a force onto the protection sleeve 160 sufficient to shear the shearable members 166. When the shearable members 166 are sheared, the protection sleeve 160 is moved downward and into contact with an inner shoulder 163 of the opening sleeve 130 as shown in FIG. 2.

Figure 2:
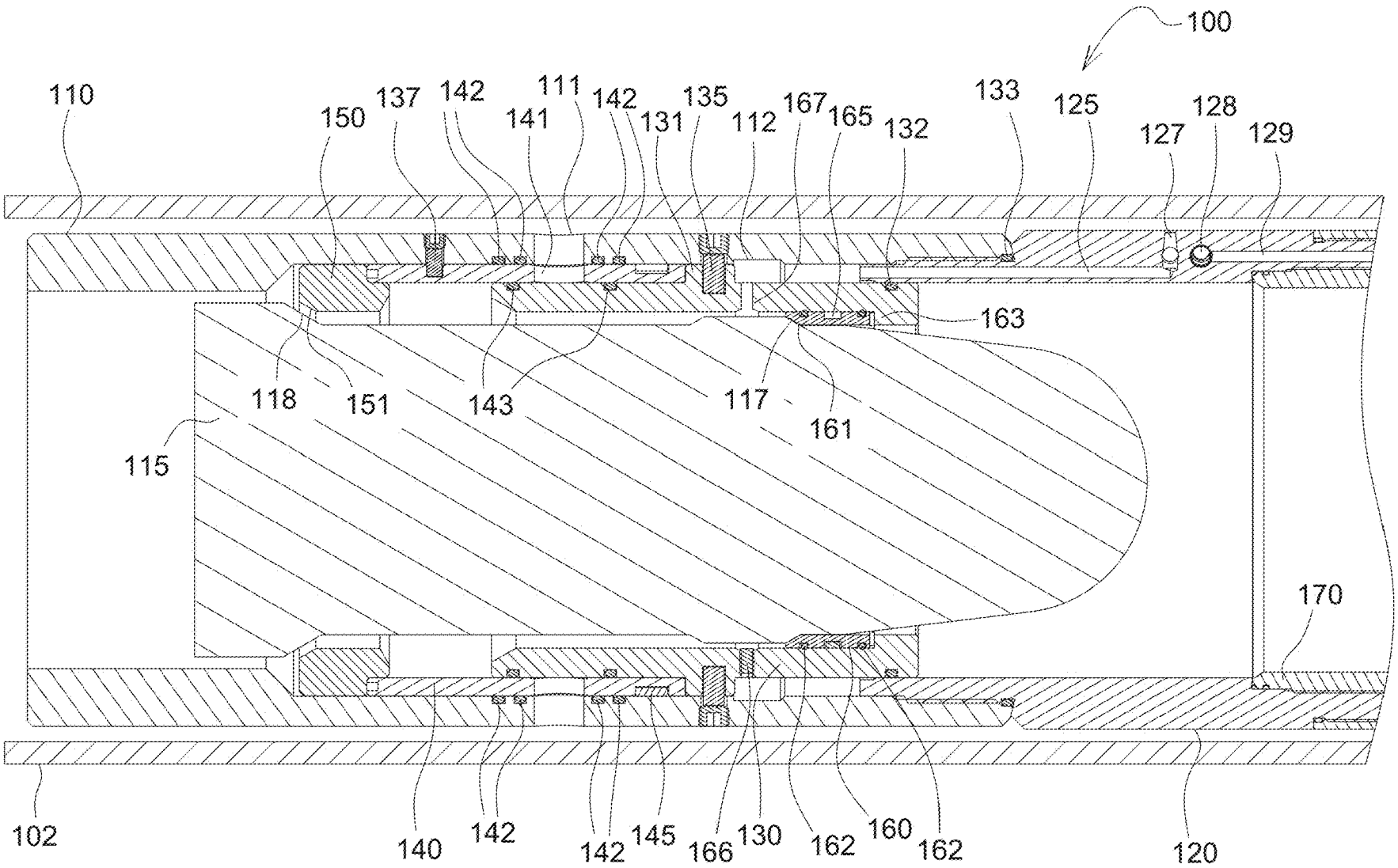
FIG. 2 is a cross-sectional view of the closing device in the stage collar in a second operational position, according to one or more embodiments.

FIG. 2 is a cross-sectional view of the closing device 115 in the stage collar 100 in a second operational position, according to one or more embodiments. In the second operational position, fluid flow is opened through bores 167 formed in the sidewall of the opening sleeve 130, which were previously seals by the seals 162 on the protection sleeve 160. Fluid can flow down into one or more flow bores 125 and out one or more flow ports 127 formed in the lower mandrel 120. The flow bore 125 is in fluid communication with the upper mandrel 110 but is initially sealed off by the protection sleeve 160, the opening sleeve 130, and the closing sleeve 140. Fluid can then flow back into one or more flow ports 128 and down one or more flow bores 129 also formed in the lower mandrel 120, which provides fluid communication to the inflatable packer 170, to inflate the inflatable packer 170. Although multiple flow bores and ports 125, 127, 128, 129 are illustrated, any number of bores and/or ports (including a single flow bore) can be disposed through the lower mandrel 120 to provide fluid communication to the inflatable packer 170. Once the inflatable packer 170 is inflated, pressure in the stage collar 100 can continue to be increased to apply a force on the closing device 115, which applies a force onto the opening sleeve 130 sufficient to shear the shearable members 135. When the shearable members 135 are sheared, the opening sleeve 130 and the closing device 115 are moved downward such that the second outer seating surface 118 of the closing device 115 contacts the inner seating surface 151 of the closing seat 150 as shown in FIG. 3.

Figure 3:
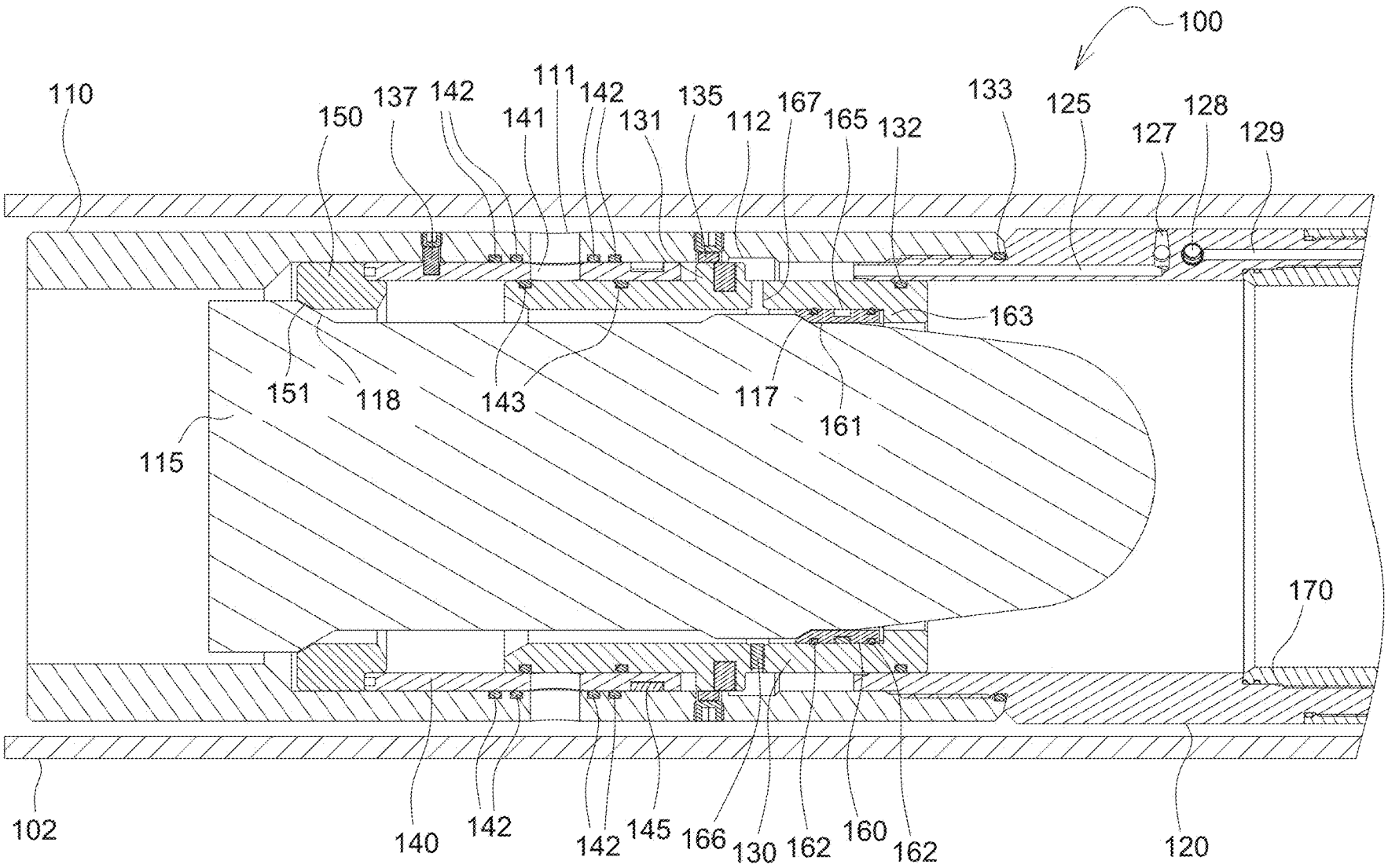
FIG. 3 is a cross-sectional view of the closing device in the stage collar in a third operational position, according to one or more embodiments.

FIG. 3 is a cross-sectional view of the closing device 115 in the stage collar 100 in a third operational position, according to one or more embodiments. In the third operational position, the second outer seating surface 118 of the closing device 115 engages the inner seating surface 151 of the closing seat 150, which closes off any fluid flow past the closing seat 150. Pressure from above can then be increased to apply a force on the closing device 115, which applies a force onto the closing seat 150 and thus the closing sleeve 140 sufficient to shear the shearable members 137. When the shearable members 137 are sheared, the closing seat 150, the closing sleeve 140, and the lock ring 145 are moved downward to place the stage collar 100 into a closed and locked position as shown in FIG. 4.

Figure 4:
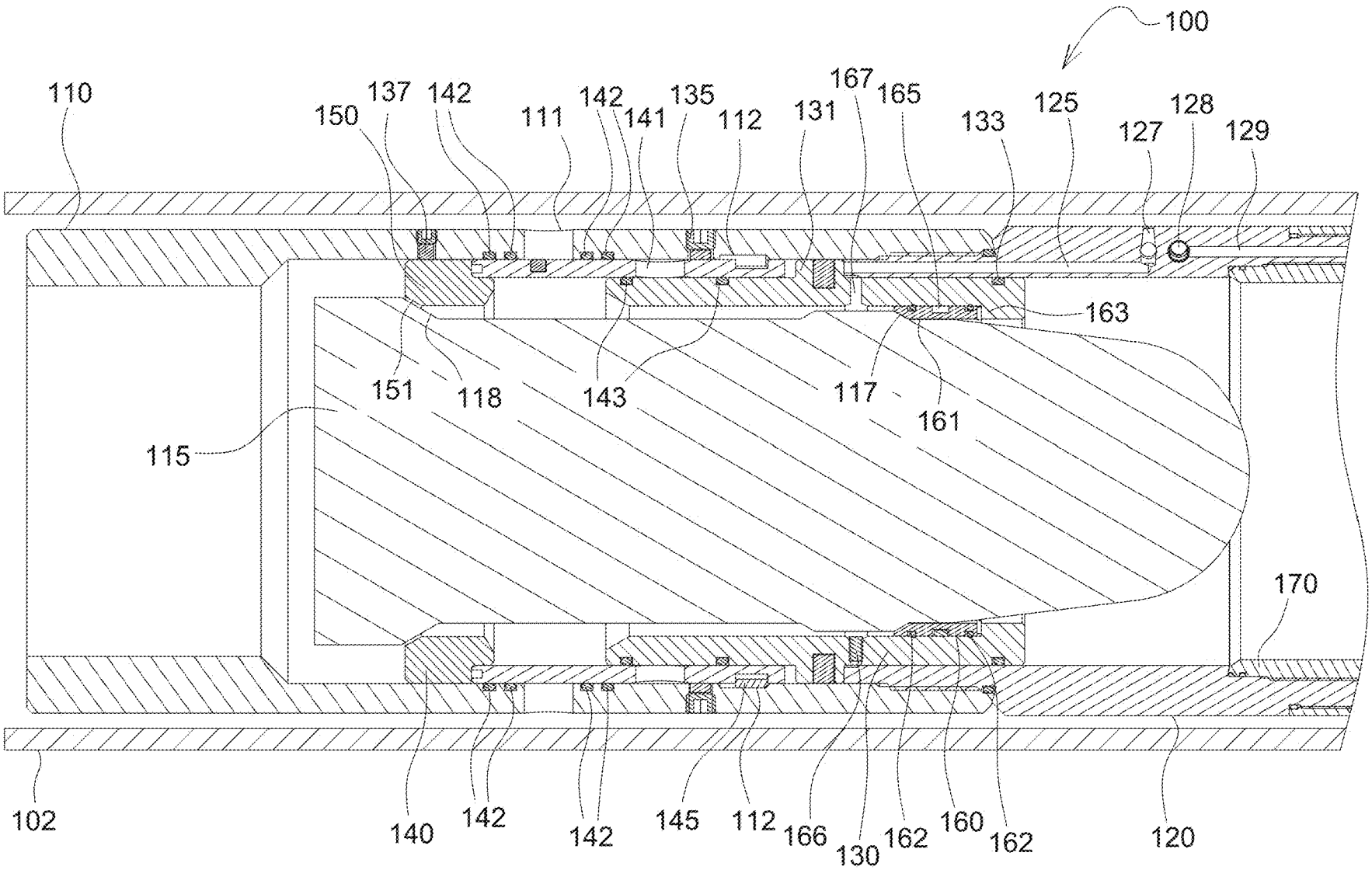
FIG. 4 is a cross-sectional view of the closing device in the stage collar in a fourth operational position, according to one or more embodiments.

FIG. 4 is a cross-sectional view of the closing device 115 in the stage collar 100 in a fourth operational position, according to one or more embodiments. In the fourth operational position, the closing sleeve 140 is moved downward in the direction toward the lower mandrel 120 until the lock ring 145 is moved and expands outward into engagement with a recess 112 formed in the inner surface of the upper mandrel 110. In the fourth operational position, the cementing ports 141 of the closing sleeve 140 and the cementing ports 111 of the upper mandrel 110 are no longer aligned, and are sealed off from each other by the seals 142, 143. Fluid communication between the stage collar 100 and the wellbore 102 is closed via the cementing ports 111, 141 when the stage collar 100 is in the closed and locked position. The lock ring 145 prevents the closing sleeve 140 from moving back in the opposite direction away from the lower mandrel 120, which prevents the cementing ports 141 from moving back into alignment with the cementing ports 111. The closing seat 150, the closing sleeve 140, and the opening sleeve 130 may be moved downward until the outer shoulder 131 of the opening sleeve 130 contacts an upper end of the lower mandrel 120.

In one embodiment, a method of operating the stage collar 100 comprises lowering the stage collar 100 in the wellbore 102 in a run in position to a desired location. The method further comprises pumping the closing device 115 into the stage collar 100 such that the first outer seating surface 117 of the closing device 115 engages the inner seating surface 161 of the protection sleeve 160. The method further comprises pressurizing the stage collar 100 to shear the shearable members 166 and move the protection sleeve 160 relative to the opening sleeve 130 to open fluid communication through the bores 167 of the opening sleeve 130.

The method further comprises pumping fluid through the bores 167 of the opening sleeve 130 and through the flow bores and flow ports 125, 127, 128, 129 formed in the lower mandrel 120 to supply fluid to and inflate the inflatable packer 170. The method further comprises pressurizing the stage collar 100 to shear the shearable members 135 and move the opening sleeve 130 and the closing device 115 relative to the closing seat 150, the closing sleeve 140, and the upper mandrel 110 such that the second outer seating surface 118 of the closing device 115 engages the inner seating surface 151 of the closing seat 150.

The method further comprises pressurizing the stage collar 100 to shear the shearable members 137 and move the stage collar 100 into the closed and locked position. In the closed and locked position, the opening sleeve 130, the closing device 115, the closing seat 150, and the closing sleeve 140 with the lock ring 145 are moved relative to the upper mandrel 110 such that the lock ring 145 extends outward into the recess 112 formed in the inner surface of the upper mandrel 110. Also, the cementing ports 111, 141 are no longer aligned and the seals 142, 143 are positioned above and below the cementing ports 111, 141 respectively. When in the closed and locked position, fluid communication between the stage collar 100 and the wellbore 102 is closed via the cementing ports 111, 141. The method further comprises drilling out one or more portions of the stage collar 100, which may include drilling out all or portions of the closing device 115, the opening sleeve 130, the closing sleeve 140, the closing seat 150, and/or the protection sleeve 160.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A stage collar assembly, comprising:

a mandrel;

an inflatable packer coupled to the mandrel;

a closing sleeve disposed in and releasably coupled to the mandrel, wherein the closing sleeve has one or more ports in alignment with one or more ports of the mandrel when the stage collar is in a run in position;

an opening sleeve disposed in and releasably coupled to the mandrel; and a protection sleeve disposed in and releasably coupled to the opening sleeve, wherein the protection sleeve comprises one or more seals configured to seal one or more bores formed through a sidewall of the opening sleeve when the stage collar is in the run in position.

2. The stage collar assembly of claim 1, further comprising a closing device having a first outer seating surface configured to engage an inner seating surface of the protection sleeve when the stage collar is in the run in position.

3. The stage collar assembly of claim 2, wherein the protection sleeve is movable relative to the opening sleeve to open fluid flow through the bores formed through the sidewall of the opening sleeve.

4. The stage collar assembly of claim 3, wherein the opening sleeve and the closing device are movable relative to the mandrel such that a second outer seating surface is configured to engage an inner seating surface of a closing seat that is coupled to an end of the closing sleeve.

5. The stage collar assembly of claim 4, wherein the closing seat, the closing sleeve, and the closing device are movable relative to the mandrel such that the ports of the closing sleeve are not aligned with the ports of the mandrel.

6. The stage collar assembly of claim 5, wherein a lock ring is movable by the closing sleeve into a recess formed in an inner surface of the mandrel to move the stage collar into a closed and locked position.

7. A method of operating a stage collar, comprises:

lowering the stage collar in a wellbore in a run in position, wherein when the stage collar is in the run in position, one or more cementing ports of an upper mandrel of the stage collar are aligned with one or more cementing ports of a closing sleeve of the stage collar;

pumping a closing device into the stage collar such that a first outer seating surface of the closing device engages an inner seating surface of a protection sleeve disposed within an opening sleeve of the stage collar;

pressurizing the stage collar to shear one or more shearable members disposed between the protection sleeve and the opening sleeve; and moving the protection sleeve relative to the opening sleeve to open fluid communication through one or more bores formed in a sidewall of the opening sleeve.

8. The method of claim 7, further comprising pumping fluid through the bores of the opening sleeve to supply fluid to and inflate an inflatable packer of the stage collar.

9. The method of claim 8, wherein fluid flows through the bores of the opening sleeve, and then flows through one or more flow bores or flow ports formed in a lower mandrel of the stage collar to provide fluid communication to the inflatable packer.

10. The method of claim 8, further comprising pressurizing the stage collar to shear one or more shearable members disposed between the opening sleeve and the upper mandrel of the stage collar.

11. The method of claim 10, further comprising moving the opening sleeve and the closing device such that a second outer seating surface of the closing device engages an inner seating surface of a closing seat that is coupled to the closing sleeve of the stage collar.

12. The method of claim 11, further comprising pressurizing the stage collar to shear one or more shearable members disposed between the closing sleeve and the upper mandrel.

13. The method of claim 12, further comprising moving the closing device, the closing seat, and the closing sleeve with a lock ring relative to the upper mandrel such that the lock ring extends outward into a recess formed in the upper mandrel to move the stage collar into a closed and locked position.

14. The method of claim 13, wherein when the stage collar is in the closed and locked position, the cementing ports of the upper mandrel are not aligned with the cementing ports of the closing sleeve such that fluid communication between the stage collar and the wellbore is closed via the cementing ports.

15. The method of claim 14, further comprising drilling out one or more portions of the closing device when the stage collar is in the closed and locked position.

16. A method of operating a stage collar, comprises:

lowering the stage collar in a wellbore in a run in position;

pumping a closing device into the stage collar such that a first outer seating surface of the closing device engages an inner seating surface of a protection sleeve disposed within an opening sleeve of the stage collar;

moving the protection sleeve relative to the opening sleeve to open fluid communication through one or more bores formed in a sidewall of the opening sleeve;

pumping fluid through the bores to inflate an inflatable packer;

moving the closing device such that a second outer seating surface of the closing device engages an inner seating surface of a closing seat coupled to a closing sleeve of the stage collar;

moving the closing sleeve to move a lock ring outward into a recess formed in a mandrel of the stage collar to place the stage collar into a closed and locked position; and pressurizing the stage collar to shear one or more shearable members disposed between the opening sleeve and the mandrel to move the closing device into engagement with the closing seat.

17. The method of claim 16, further comprising pressurizing the stage collar to shear one or more shearable members disposed between the protection sleeve and the opening sleeve to move the protection sleeve relative to the opening sleeve.

18. The method of claim 17, further comprising pressurizing the stage collar to shear one or more shearable members disposed between the closing sleeve and the mandrel to move the closing sleeve and the lock ring to place the stage collar into the closed and locked position.

* * * * *